US011231245B1

(12) United States Patent
Pintar

(10) Patent No.: US 11,231,245 B1
(45) Date of Patent: Jan. 25, 2022

(54) RATCHETED SUPPORT ANTI-CHARGING GUN LOCK SYSTEM

(71) Applicant: Blac-Rac Manufacturing, Inc., Meridian, ID (US)

(72) Inventor: Kevin Pintar, Meridian, ID (US)

(73) Assignee: BLAC-RAC MANUFACTURING, INC., Boise, ID (US)

( * ) Notice: Subject to any disclaimer, the term of this patent is extended or adjusted under 35 U.S.C. 154(b) by 0 days.

(21) Appl. No.: 17/099,087

(22) Filed: Nov. 16, 2020

(51) Int. Cl.
*F41A 17/22* (2006.01)
*F41A 17/54* (2006.01)

(52) U.S. Cl.
CPC ..... *F41A 17/22* (2013.01); *F41A 17/54* (2013.01)

(58) Field of Classification Search
None
See application file for complete search history.

(56) References Cited

U.S. PATENT DOCUMENTS 5,548,915 A * 8/1996 Szarmach ..... F41A 17/02 340/542
5,551,181 A * 9/1996 Upton ..... F41A 17/54 42/70.07
5,899,102 A * 5/1999 Ling ..... F41A 17/54 70/312
6,272,784 B1 * 8/2001 Ringers ..... F41A 17/54 42/70.07
7,658,028 B2 * 2/2010 Pintar ..... F41A 17/02 42/70.07
8,266,835 B2 * 9/2012 Pintar ..... F41A 17/02 42/70.07
10,139,184 B1 * 11/2018 Pintar ..... B60R 7/14
10,578,390 B2 * 3/2020 Pintar ..... A47B 81/005
2003/0066228 A1 * 4/2003 Smith ..... F41A 17/54 42/70.11
2008/0134556 A1 * 6/2008 Remelin ..... F41A 17/54 42/70.07
2019/0212086 A1 * 7/2019 Shiner ..... F41A 17/06

* cited by examiner

*Primary Examiner* — Bret Hayes
(74) *Attorney, Agent, or Firm* — Parsons Behle & Latimer

(57) ABSTRACT

A weapon retention system may include a base assembly, a first plate coupled to the base assembly, and a second plate coupled to the base assembly, where a distance between the plates while the base assembly is in an open state is greater than a distance between the plates while the base assembly is in a closed state, where the first plate and the second plate are configured to retain the weapon between the first plate and the second plate while the base assembly is in the closed state. The system may further include a linear ratchet coupled to the first plate. The system may also include a pistol grip rest coupled to the first plate, where the pistol grip includes a pin configured to engage the linear ratchet for unidirectional adjustment while the pistol grip rest is in a first state.

20 Claims, 12 Drawing Sheets

RATCHETED SUPPORT ANTI-CHARGING GUN LOCK SYSTEM

FIELD OF THE DISCLOSURE

This disclosure is generally related to the field of weapon retention systems such as gun lock systems and, in particular, to ratcheted support anti-charging gun lock systems.

BACKGROUND

Typical weapon retention systems, also referred to herein as gun lock systems, prevent the unauthorized access to a weapon by locking key portions of the weapon, thereby neutralizing the weapon while it is positioned within the system. Weapon retention systems may be employed by law enforcement, military, or others to secure weapons while they are not in use. One way that weapon retention systems may secure a weapon is by securing a receiver of the weapon at key points, such as behind a pistol grip, within a trigger guard, around a barrel attachment, and elsewhere. Typical systems may further include anti-charging structures to prevent charging the weapon while it is retained.

However, current gun lock systems may be limited in the range of weapons that can be secured. For example, if the distance between a pistol grip rest and an anti-charging structure of a gun lock system is designed to secure an arma-lite-type (AR-type) rifle, then the gun lock may not be able to secure a shotgun. Likewise, gun locks that are designed to secure shotguns may not be capable of securing an AR-type rifle. Additionally, it may be dangerous to use posts or other structures to secure the weapon at some sensitive points, such as within the trigger guard. Other disadvantages may exist.

SUMMARY

Disclosed is a weapon retention system that overcomes at least one of the disadvantages described above. In an embodiment, a weapon retention system includes a base assembly. The system further includes a first plate coupled to the base assembly. The system also includes a second plate coupled to the base assembly, where an open distance between the first plate and the second plate while the base assembly is in an open state is greater than a closed distance between the first plate and the second plate while the base assembly is in a closed state, where the first plate and the second plate are configured to receive a weapon therebetween, and where the first plate and the second plate are configured to retain the weapon between the first plate and the second plate while the base assembly is in the closed state. The system also includes a linear ratchet coupled to the first plate. The system includes a pistol grip rest coupled to the first plate, where the pistol grip includes a pin configured to engage the linear ratchet for unidirectional adjustment while the pistol grip rest is in a first state.

In some embodiments, the pin is configured to disengage the linear ratchet for multidirectional adjustment while the pistol grip rest is in a second state. In some embodiments, the weapon interferes with switching the pistol grip rest from the first state to the second state while the weapon is retained between the first plate and the second plate and while a pistol grip of the weapon is resting against the pistol grip rest. In some embodiments, the pistol grip rest includes a first portion and a second portion, where the second portion is configured shift relative to the first portion between a first position associated with the first state and a second position associated with the second state. In some embodiments, the pin includes a main body positioned within the first portion and a lateral post positioned within the second portion, and shifting the second portion to the second position interacts with the lateral post to draw the pin away from the linear ratchet. In some embodiments, the pin is spring loaded and shifting the second portion to the first position enables a spring to push the pin toward the linear ratchet.

In some embodiments, the ratchet enables the unidirectional adjustment at ⅛-inch intervals. In some embodiments, the ratchet includes four ratchet steps. In some embodiments, the first plate and the second plate omit any post configured to be positioned within a trigger guard of the weapon while the weapon is retained between the first plate and the second plate. In some embodiments, the first plate is configured to interfere with charging the weapon while the weapon is retained between the first plate and the second plate. In some embodiments, a first shape of the first plate and a second shape of the second plate are configured to retain an Arma-Lite-type (AR-type) rifle or a shotgun between the first plate and the second plate while the base assembly is in the closed state. In some embodiments, the base assembly includes a handle that is moveable between a first handle position and a second handle position, where the first handle position is associated with the open state and the second handle position is associated with the closed state, and where the handle is configured to lock in the second position.

In an embodiment, a weapon retention method includes, in response to movement of a handle of a base assembly from a first position to second position, reducing a distance between a first plate coupled to the base assembly and a second plate coupled to the base assembly to a closed distance, where the closed distance is associated with a closed state of the base assembly. The method further includes retaining a weapon between the first plate and the second plate while the base assembly is in the closed state. The method also includes adjusting a pistol grip rest along a linear ratchet until the pistol grip rest engages a pistol grip of the weapon, wherein the pistol grip includes a pin configured to engage the linear ratchet for unidirectional adjustment while the pistol grip rest is in a first state.

In some embodiments, the pin is configured to disengage the linear ratchet for multidirectional adjustment while the pistol grip rest is in a second state. In some embodiments, the pistol grip rest includes a first portion and a second portion and the method further includes, in response to shifting of the second portion relative to the first portion from a first position associated with the first state to a second position associated with the second state, drawing the pin away from the linear ratchet. In some embodiments, the method further includes, in response to shifting of the second portion to the first position, pushing the pin toward the linear ratchet. In some embodiments, retaining the weapon between the first plate and the second plate is performed without positioning a post within a trigger guard of the weapon. In some embodiments, the method includes interfering, by the first plate, with charging the weapon while the weapon is retained between the first plate and the second plate.

In an embodiment, a weapon retention system includes a base assembly. The system further includes a first plate coupled to the base assembly. The system also includes a second plate coupled to the base assembly. The system includes a linear ratchet coupled to the first plate. The system further includes a pistol grip rest coupled to the first plate, where the pistol grip rest includes a pin configured to engage the linear ratchet for unidirectional adjustment while the pistol grip rest is in a first state, and where the pin is configured to disengage the linear ratchet for multidirectional adjustment while the pistol grip rest is in a second state.

In some embodiments, the first plate and the second plate omit any post configured to be positioned within a trigger guard of the weapon while the weapon is retained between the first plate and the second plate, and the first plate is configured to interfere with charging the weapon while the weapon is retained between the first plate and the second plate.

Figure 1:
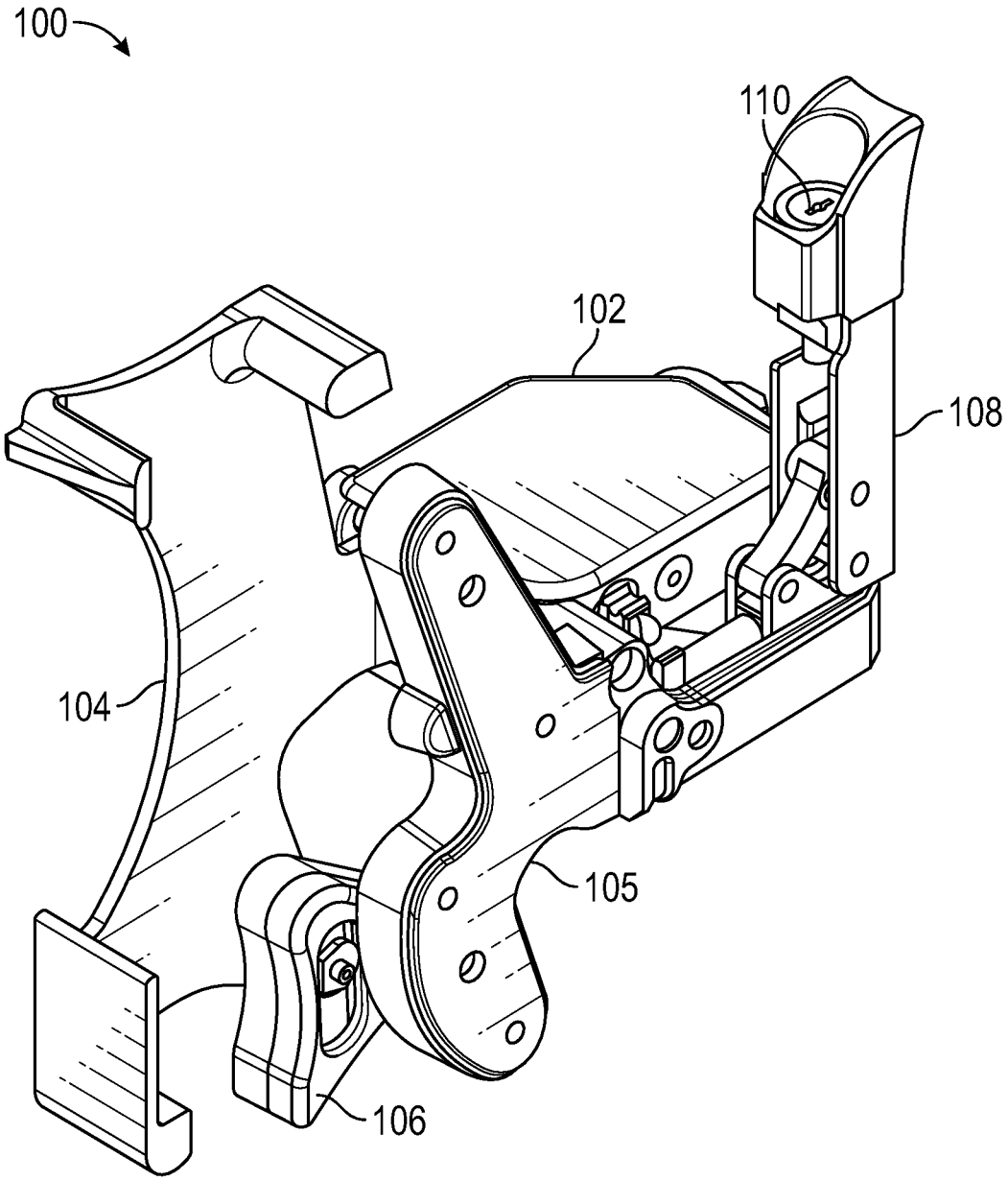
FIG. 1 is a perspective drawing of an embodiment of a weapon retention system.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure.

DETAILED DESCRIPTION

Referring to FIG. 1, an embodiment of a weapon retention system 100 is depicted. In FIG. 1, the system 100 is shown in an open state. While in the open state, a weapon can be entered into the system 100 or removed from the system 100.

The system 100 may include a base assembly 102. The base assembly 102 may provide locking functions and mounting functions to enable the system 100 to pass between a closed state and an open state. As such, the base assembly 102 may be switched between an open state and a closed state. An example of a base assembly that may be used with the system 100 is described in U.S. Pat. No. 8,266,835, filed on Jan. 6, 2010, and entitled "Firearm Security Device," the contents of which are incorporated by reference herein in their entirety.

A handle 108 may be used to switch a state of the base assembly 102. When the handle 108 is in an up, or vertical, position, the base assembly 102 may be in an open state. When the handle 108 is in a down, or horizontal position, the base assembly 102 may be in a closed state. The handle 108 may include one or more mechanical locking mechanisms 110. Further, the base assembly 102 may include one or more electronic locking and/or release mechanisms. An example of an electronic release mechanism that may be used with the base assembly 102 is described in U.S. Pat. No. 10,584,931, filed on Mar. 18, 2019, and entitled "Systems and Methods to Prevent Hot-Wiring of Electronic Gun Racks," the contents of which are incorporated by reference herein in their entirety.

The system 100 may include a first plate 104 coupled to the base assembly 102. The first plate 104 may be fixed relative to the base assembly 102 such that it does not move when the base assembly 102 switched from the open state to the closed state. The system 100 may further include a second plate 105 coupled to the base assembly 102. The second plate 105 may be configured to move between an open position and a closed position that correspond to the base assembly 102 being in the open state and the closed state.

Figure 2:
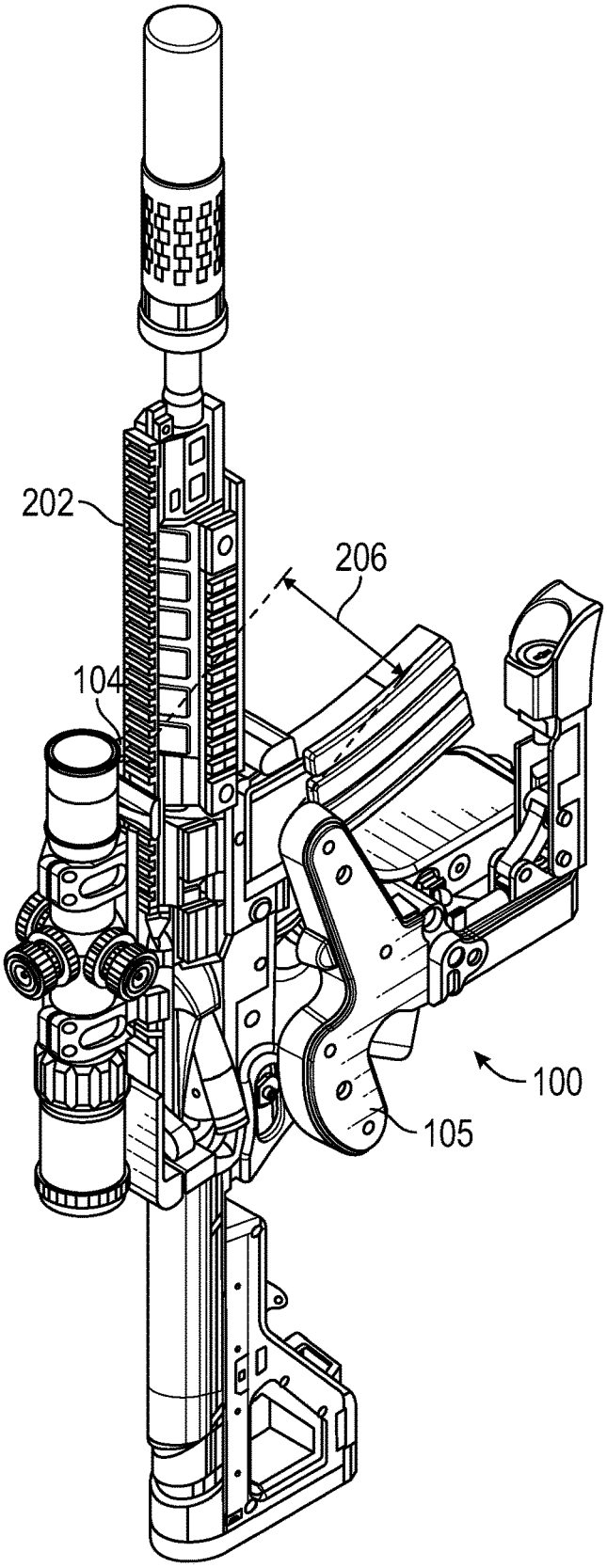
FIG. 2 is a perspective drawing of a weapon positioned within an embodiment of a weapon retention system that is in an open state.

Referring to FIG. 2, the system 100 may be configured to receive a weapon 202 between the first plate 104 and the second plate 105 while the base assembly 102 is in the open state. For example, in the open state, an open distance 206 between the first plate 104 and the second plate 105 may be sufficient to insert and/or remove the weapon 202.

Figure 3:
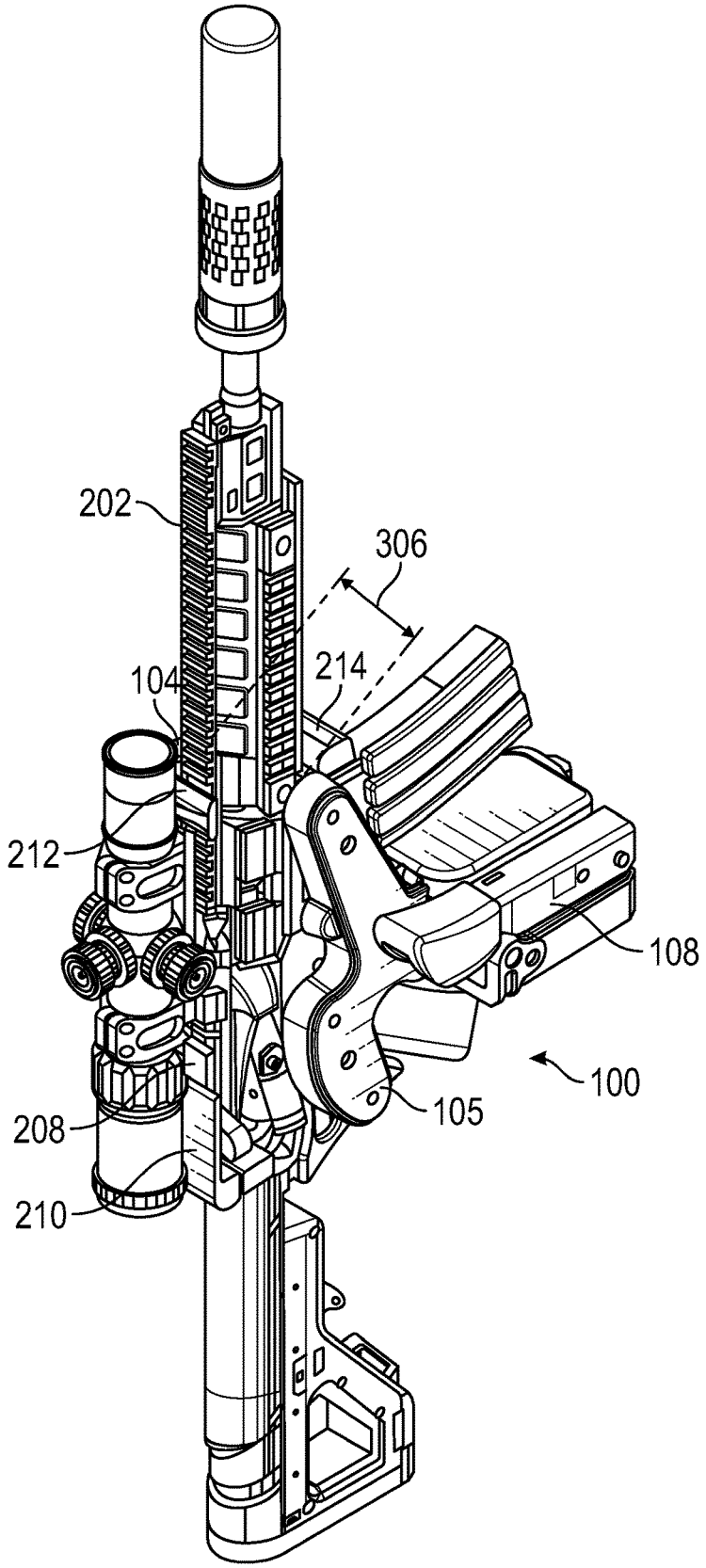
FIG. 3 is a perspective drawing of a weapon positioned within an embodiment of a weapon retention system that is in a closed state.

Referring to FIG. 3, the base assembly 102 may be switched to the closed state using the handle 108. In the closed state, a closed distance 306 between the first plate 104 and the second plate 105 may prevent the weapon 202 from being removed. For example, the closed distance 306 may be less than the open distance 206. Thus, while in the closed state, the first plate 104 and the second plate 105 may apply pressure to a receiver 208 of the weapon 202. Further, the first plate 104 and the second plate 105 may include structures to retain portions of the weapon 202. For example, the first plate 104 may include a lower plate 210, a first stud 212, and a second stud 214 to secure the weapon 202 at multiple points.

Figure 4:
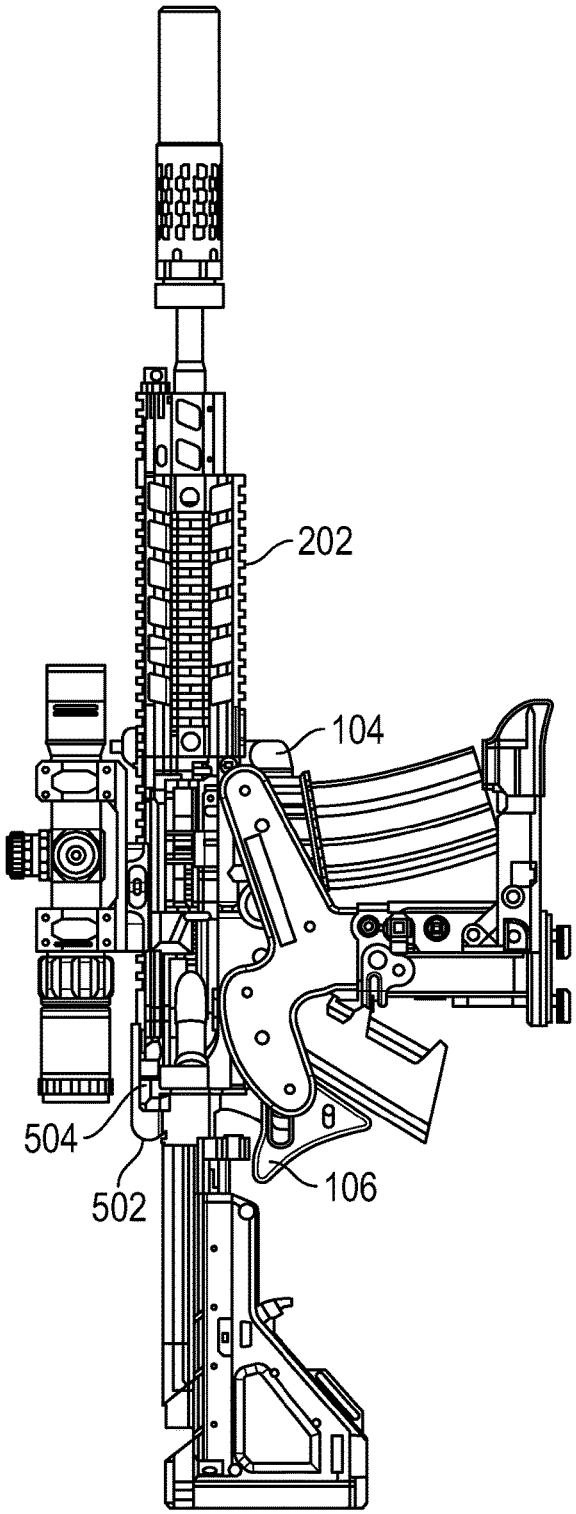
FIG. 4 is a side view of a weapon positioned within an embodiment of a weapon retention system that is in an open state.

Referring to FIG. 4, the system 100 is depicted in an open state and may include a pistol grip rest 106 coupled to the first plate 104. The pistol grip rest 106 may have multiple states. In a first state, the pistol grip rest 106 may be unidirectionally adjustable. For example, the pistol grip rest 106 may move upward toward the weapon 202, but not downward away from the weapon 202 to prevent the weapon 202 from being removed or otherwise loosened while the base assembly 102 is in the closed state. In a second state, the pistol grip rest 106 may be multi-directionally adjustable. For example, the pistol grip rest 106 may move upward or downward. As described further herein, the pistol grip rest 106 may be prevented from entering in the second state while a weapon is resting against it. Thus, when the weapon 202 is retained between the first plate 104 and the second plate 105 the pistol grip rest 106 may be prevented from being adjusted downward and may aid in retaining the weapon 202. The adjustability of the pistol grip rest 106 is further described herein. when the weapon 202 is resting on the pistol grip rest 106, the first plate 104 may interfere with and prevent charging the weapon 202. For example, the first plate 104 may abut the weapon 202 at a point 502 that interferes with a charging mechanism 504 of the weapon 202.

Figure 5:
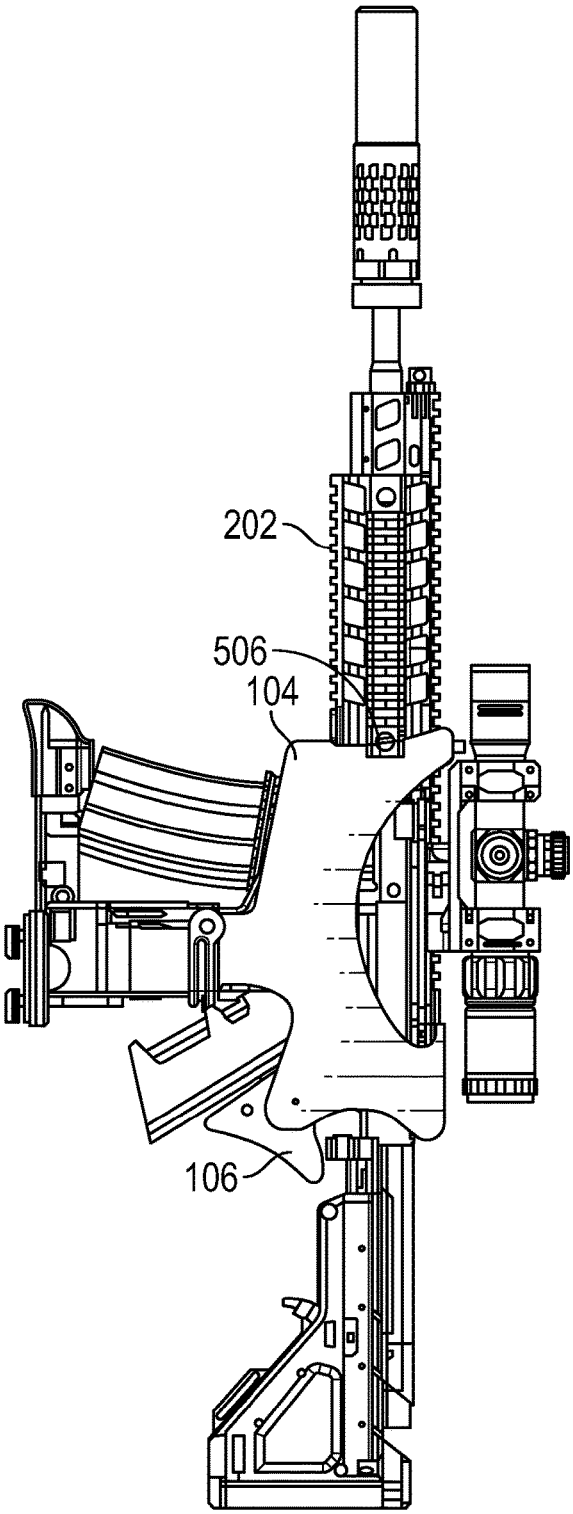
FIG. 5 is a side view of a weapon positioned within an embodiment of a weapon retention system that is in an open state.

Referring to FIG. 5, the first plate 104 may also interfere with charging other types of weapons, such as a shotgun. For example, even though FIG. 5 depicts the weapon 202 as a rifle, the first plate 104 may abut the weapon 202 at another point 506 that interferes with a charging mechanism of a shotgun.

Figure 6:
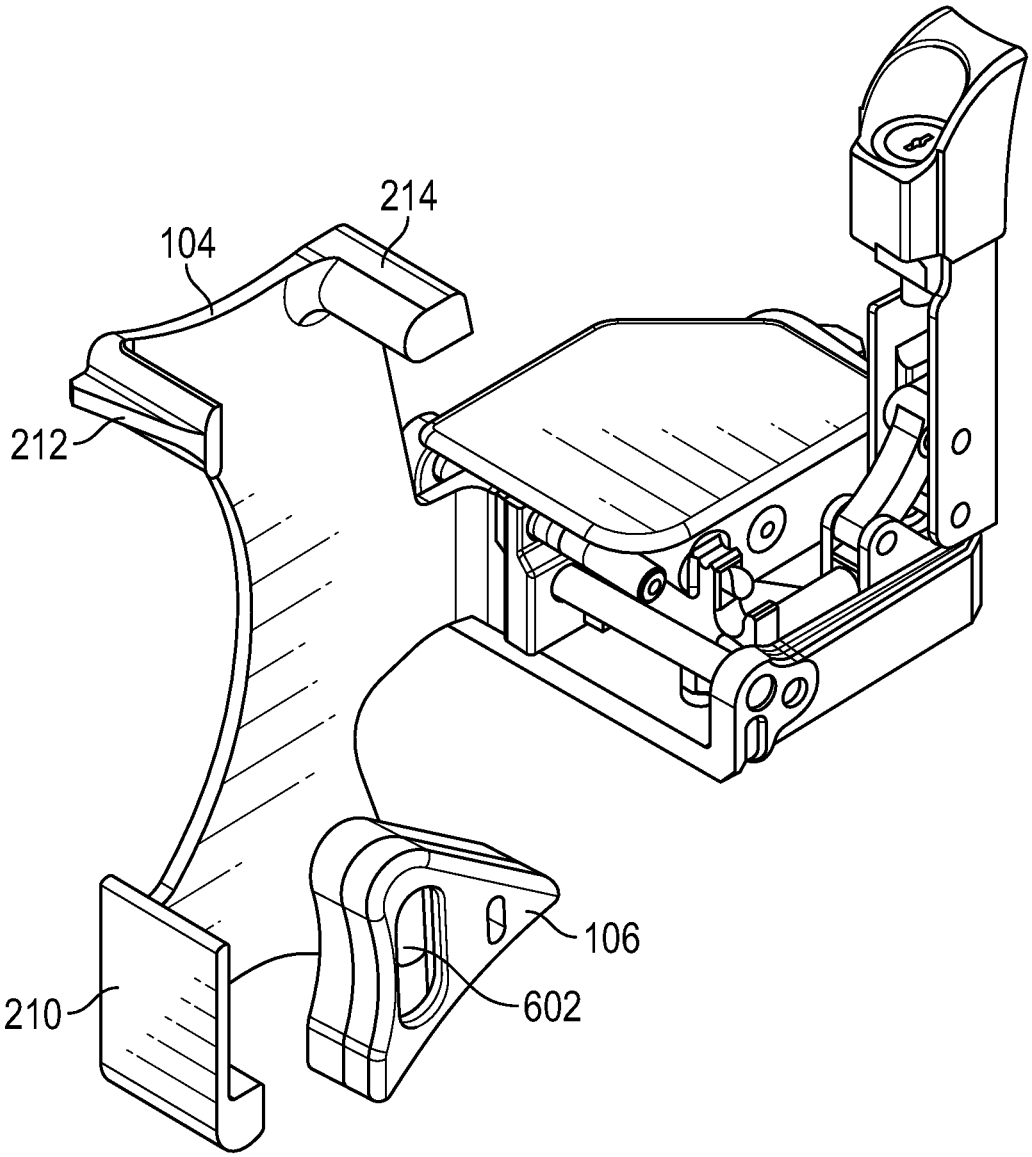
FIG. 6 is a perspective drawing of an embodiment of a weapon retention system.

Referring to FIG. 6, the system 100 is depicted in an open state. For clarity, the second plate 105 has been removed from FIG. 6 to provide an unobstructed view of the first plate 104 and the pistol grip rest 106. As seen in FIG. 6, the first plate 104 may omit any structure to be positioned within a trigger guard of the weapon 202. However, the first plate 104 may include structures to retain the weapon 202. For example, the first plate 104 may include a lower plate 210, a first stud 212, and a second stud 214 to secure the weapon 202 at multiple points. Other structures and configurations are also possible. While typical gun locks may rely on a stud or other structure positioned within the trigger guard to prevent removal of the weapon 202, such systems may require more attention on the part of a user to ensure the safe insertion and removal of the weapon 202 and to prevent accidental discharge. By omitting any structure within the trigger guard of the weapon 202, the system 100 may be safer as compared to other gun locks.

A linear ratchet 602 may be coupled to the first plate 104. The pistol grip rest 106 may interact with the linear ratchet 602 to provide for unidirectional adjustment of the pistol grip rest 106 while the pistol grip rest 106 is in a first state and multidirectional adjustment while the pistol grip rest 106 is in a second state.

Figure 7:
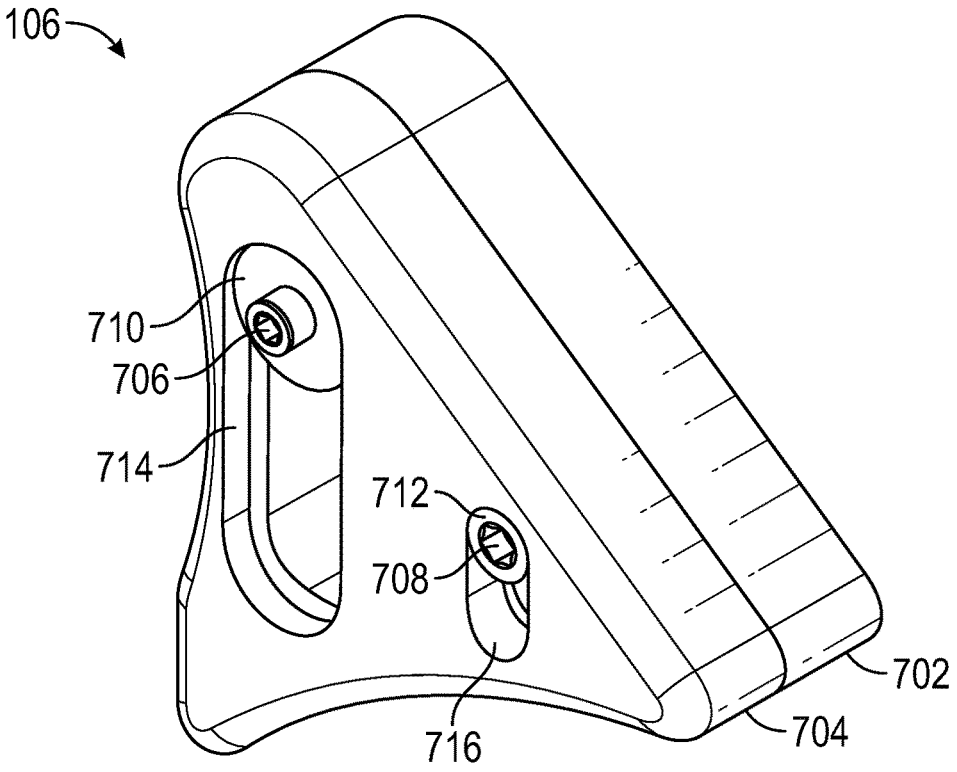
FIG. 7 is a perspective drawing of an embodiment of a pistol grip rest in a first state.

Referring to FIG. 7, an embodiment of a pistol grip rest 106 is depicted. As shown in FIG. 7, the pistol grip rest 106 may have a triangular shape in order to better conform to the shape of a weapon at a point behind a pistol grip of the weapon. This may enable a weapon to securely rest on the pistol grip rest 106.

The pistol grip rest 106 may include a first portion 702 and a second portion 704. The portions 702, 704 may sit flush with each other and may be held together by a first fastener 706 and a second fastener 708. A head 710 of the first fastener 706 may sit in a first elongate groove 714 within the second portion 704. A head 712 of the second fastener 708 may sit in a second elongated groove 716 within the second portion 704. As shown in FIG. 7, the head 710 of the first fastener 706 may include a washer or spacer, or other type of structure to expand a physical area of the head 710. The elongated grooves 714, 716 may enable the second portion 704 to shift with respect to the first portion 702. A result of the shifting may be that the second portion 704 move between a first position, as shown in FIG. 7, and a second state as described elsewhere herein. While the second portion 704 is in the first position, as shown in FIG. 7, the pistol grip rest 106 may be referred to herein as being in a first state.

Figure 8:
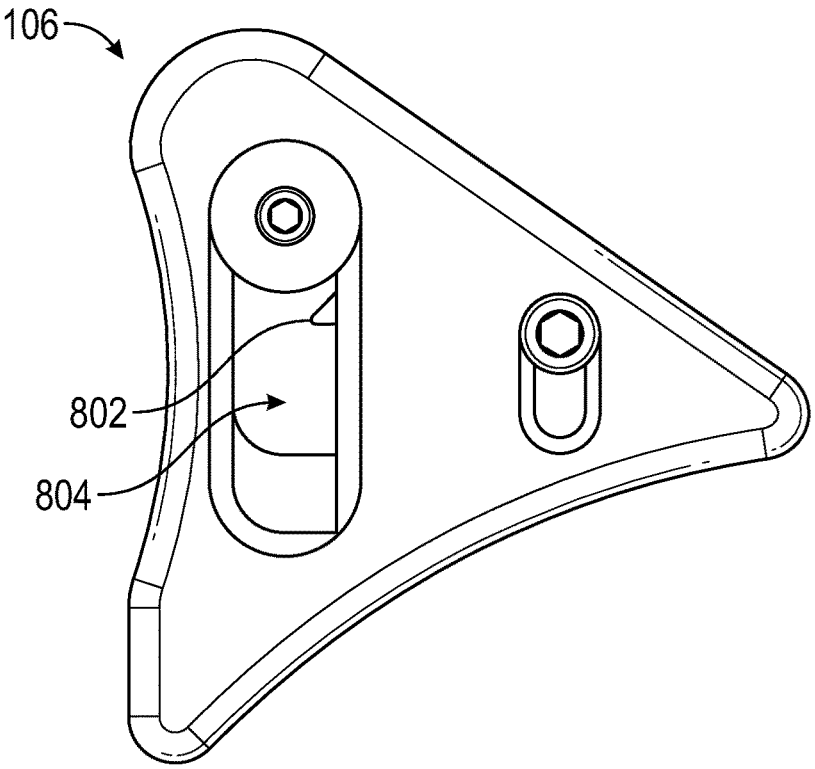
FIG. 8 is a front view of an embodiment of a pistol grip rest in a first state.

Referring to FIG. 8, the pistol grip rest 106 may include a pin 802 positioned at least partially within a body of the first portion 702. The pin 802 may be configured to engage the linear ratchet 602 (not shown in FIG. 8) for unidirectional adjustment while the pistol grip rest 106 is in a first state. The first portion 702 may include an opening 804 defined therein. While the pistol grip rest 106 is in the first state, the pin 802 may extend into the opening 804. This may enable the pin 802 to engage a linear ratchet while the pistol grip rest 106 is in the first state, as described herein.

Figure 9:
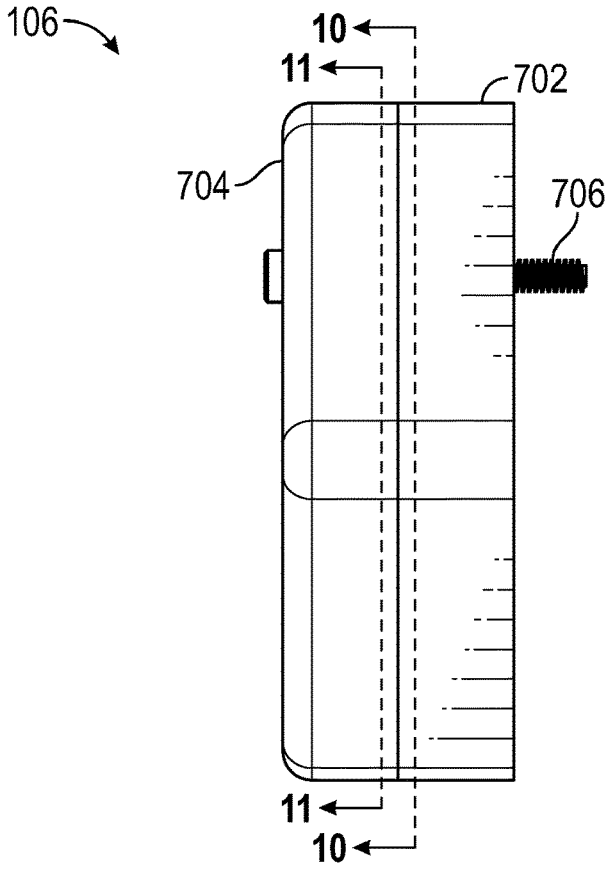
FIG. 9 is a side view of an embodiment of a pistol grip rest in a first state.

Referring to FIG. 9, references for cross-section views are provided and may be helpful in describing the inner workings of the pistol grip rest 106. FIG. 9 shows a first cross section line that corresponds to FIG. 10 and a second cross-section line that corresponds to FIG. 11. Also, shown in FIG. 9, the first fastener 706 may pass through both the first portion 702 and the second portion 704 and extend past the first portion 702. Although not shown in FIG. 9, the first fastener 706 may screw into the first plate 104 of the weapon retention system 100 to hold the portions 702, 704 together and to hold the first portion 702 flush with the first plate 104. As shown in FIG. 3, the second plate 105 may cover the first fastener 706 to prevent removal of the pistol grip rest 106 while the base assembly 102 is in the closed position.

Figure 10:
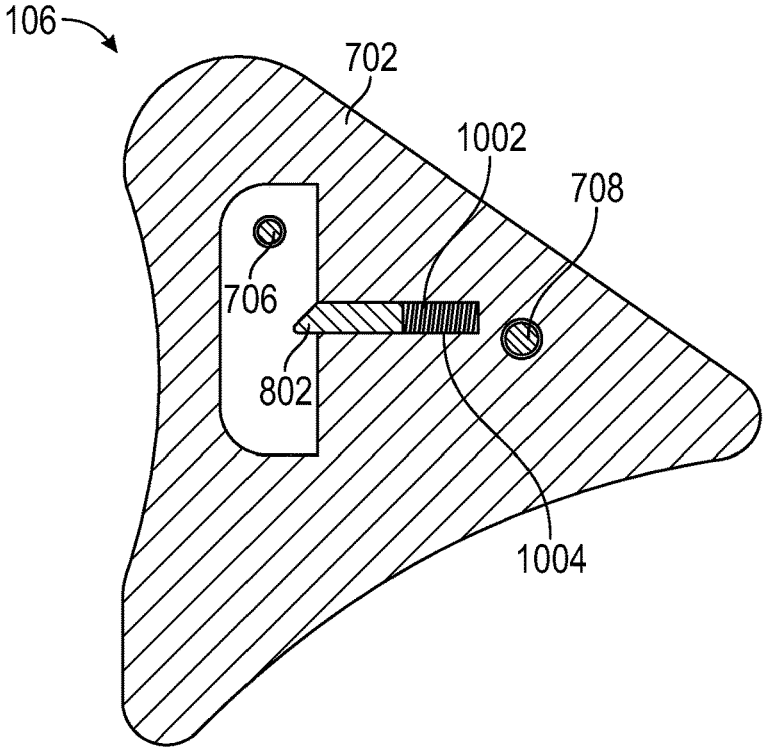
FIG. 10 is a cross-section view of an embodiment of a pistol grip rest in a first state.

Referring to FIG. 10, a cross-section of the pistol grip rest 106 is depicted. The cross-section of FIG. 10 is taken inside the first portion 702 of the pistol grip rest 106. As shown, the pin 802 may be positioned within a cavity 1004 of the first portion 702. A spring 1002 may also be positioned within the cavity 1004 of the first portion 702. The spring 1002 may apply a force to the pin 802 to press against the linear ratchet 602 (not shown in FIG. 10). The fasteners 706, 708 may also pass through the first portion 702.

Figure 11:
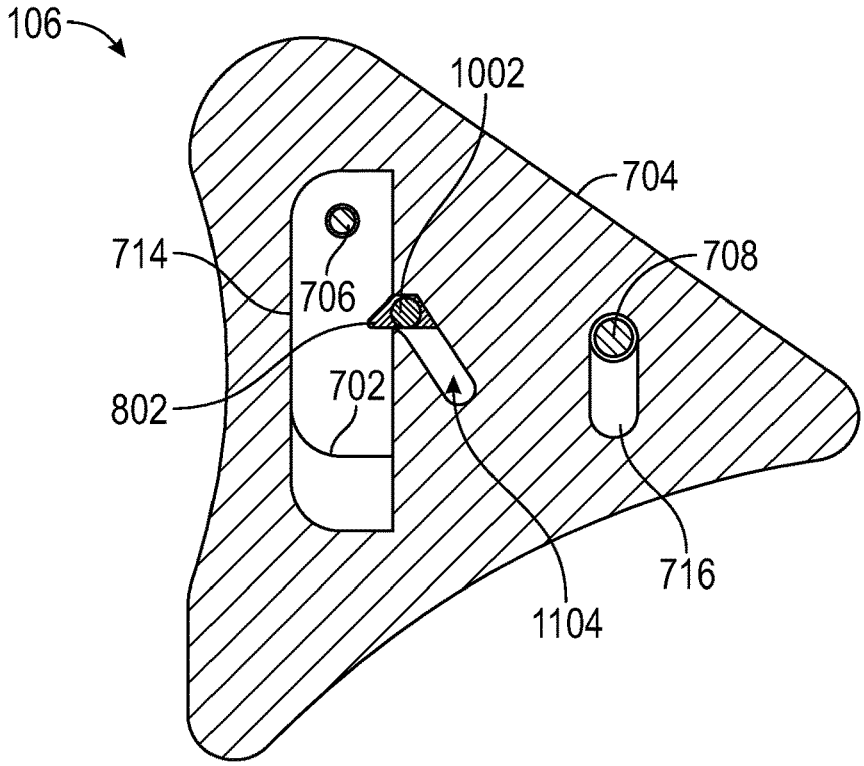
FIG. 11 is a cross-section view of an embodiment of a pistol grip rest in a first state.

Referring to FIG. 11, a cross-section of the pistol grip rest 106 is depicted. The cross-section of FIG. 11 is taken within the second portion 704. As explained above, the elongated grooves 714, 716 may enable the second portion 704 to shift relative to the first portion 702 in a direction consistent with a direction of the elongated grooves 714, 716. Shifting in other directions may be prevented by the fasteners 706, 708. An oblique groove 1104 may be defined within an interior of the second portion 704. The pin 802 may include a lateral post 1102 that extends into the oblique groove 1104. As the second portion 704 shifts relative to the first portion 702, the oblique groove 1104 may interact with the lateral post 1102 to withdraw the pin 802 into the first portion 702, as described herein.

Figure 12:
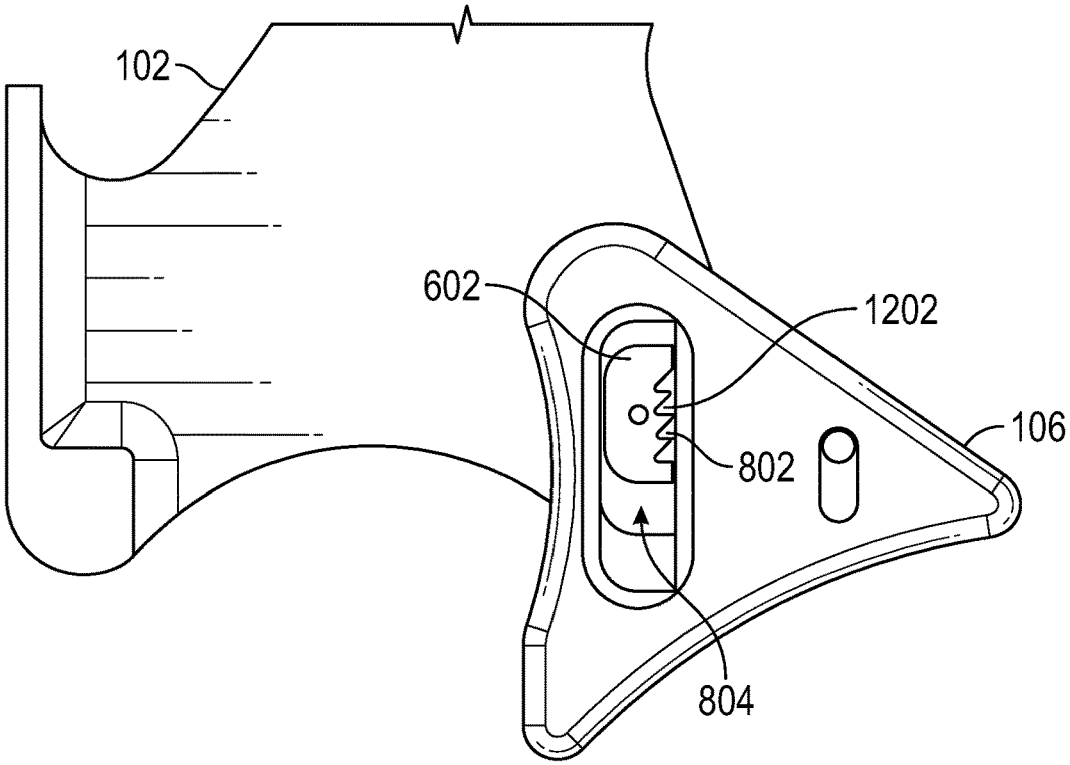
FIG. 12 is a front view of an embodiment of a pistol grip rest attached to a plate and a linear ratchet.

Referring to FIG. 12, the pistol grip rest 106 is depicted as being attached to the first plate 104. The fasteners 706, 708 have been omitted from FIG. 12 for clarity. The linear ratchet 602 may be attached to the first plate 104 (e.g., by the first fastener 706) and the pistol grip rest 106 may be positioned such that the linear ratchet is within the opening 804. While the pistol grip rest is in the first state (as shown) the pin 802 may enter into individual ratchet steps 1202. For simplicity, only one ratchet step at the top of the linear ratchet 602 has been labeled in FIG. 12. The interaction between the linear ratchet 602 and the pin 802 may enable unidirectional adjustment (e.g. upward) of the pistol grip rest 106 while preventing adjustment in other directions (e.g., downward) while the pistol grip rest 106 is in the first state. In some embodiments, the adjustments may occur at ⅛-inch intervals corresponding to the ratchet steps 1202. The linear ratchet 602 may include four ratchet steps 1202 for a total distance of ½-inch adjustment.

Figure 13:
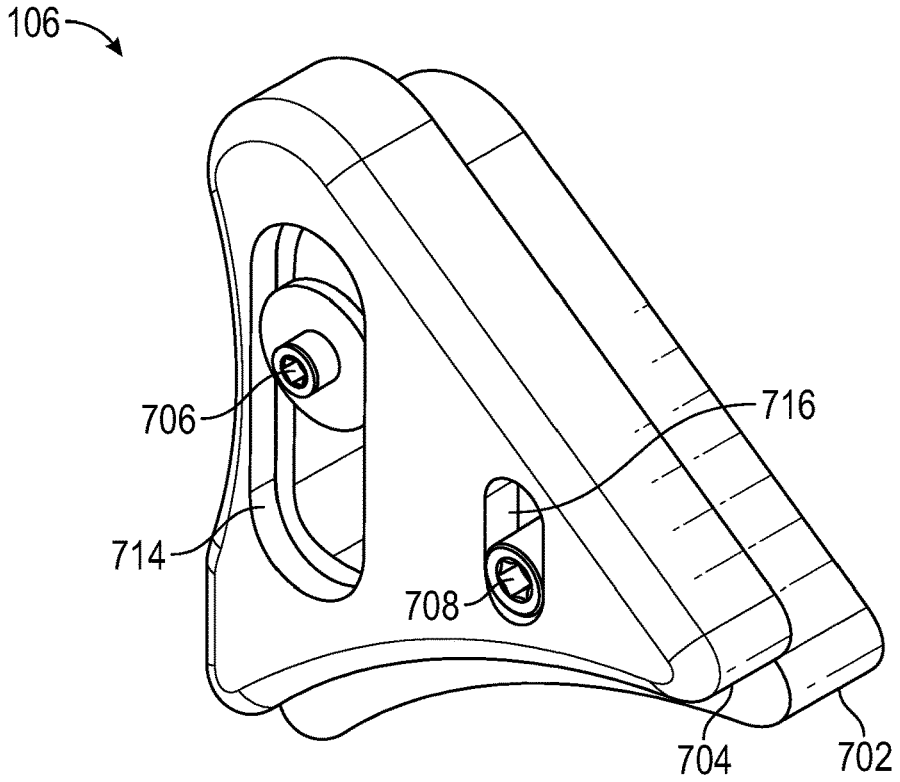
FIG. 13 is a perspective drawing of an embodiment of a pistol grip rest in a second state.
Figure 14:
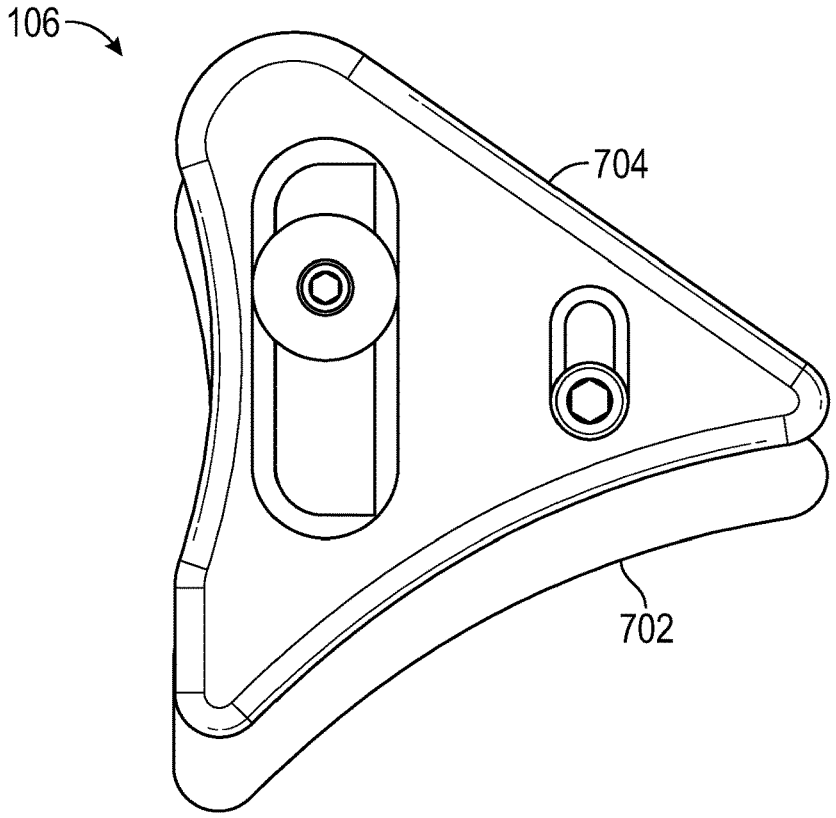
FIG. 14 is a front view of an embodiment of a pistol grip rest in a second state.

Referring to FIG. 13, the embodiment of the pistol grip rest 106 is depicted in the second state, where the second portion 704 has been shifted relative to the first portion 702 such that the fasteners 706, 708 are lower within the elongated grooves 714, 716. FIG. 14 provides a clear depiction showing that the second portion 704 has shifted linearly along the direction of the elongated grooves 714, 716.

Figure 15:
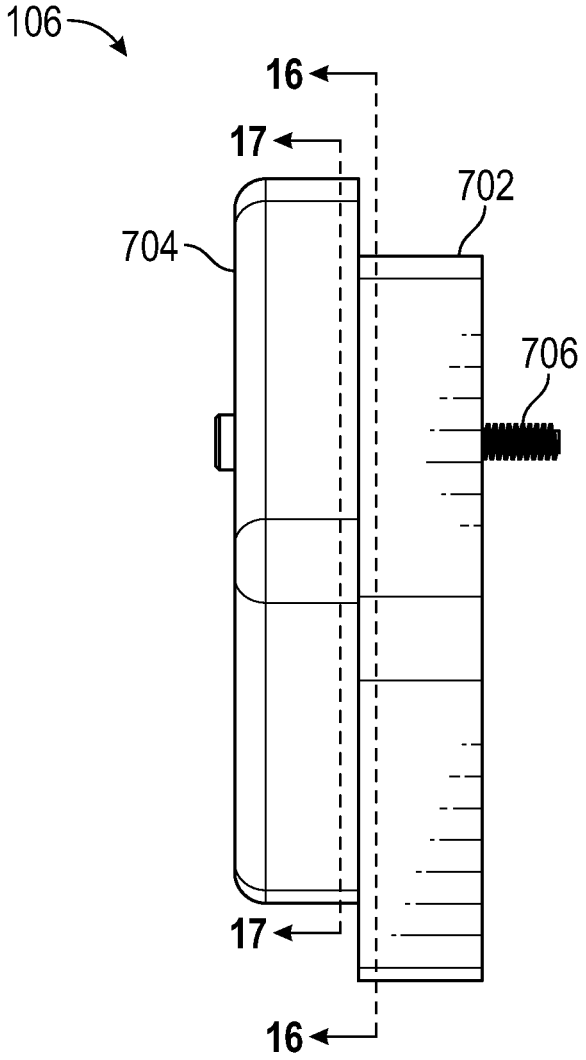
FIG. 15 is a side view of an embodiment of a pistol grip rest in a second state.

Referring to FIG. 15, references for cross-section views are provided and may be helpful in describing the inner workings of the pistol grip rest 106 while in the second state. FIG. 15 shows a first cross section line that corresponds to FIG. 16 and a second cross-section line that corresponds to FIG. 17. Also, shown in FIG. 15, while the second portion 704 has shifted relative to the first portion 702, the first fastener 706 has not moved relative to the first portion 702. Thus, the first fastener 706 may continue to hold the portions 702, 704 together and to hold the first portion 702 flush with the first plate 104 (not shown in FIG. 15).

Figure 16:
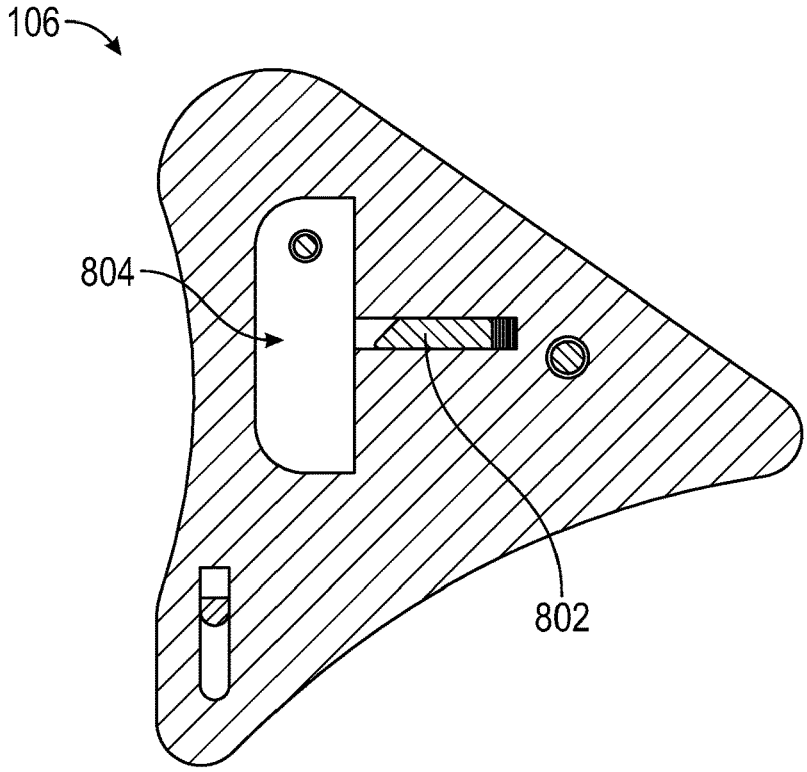
FIG. 16 is a cross-section view of an embodiment of a pistol grip rest in a second state.
Figure 17:
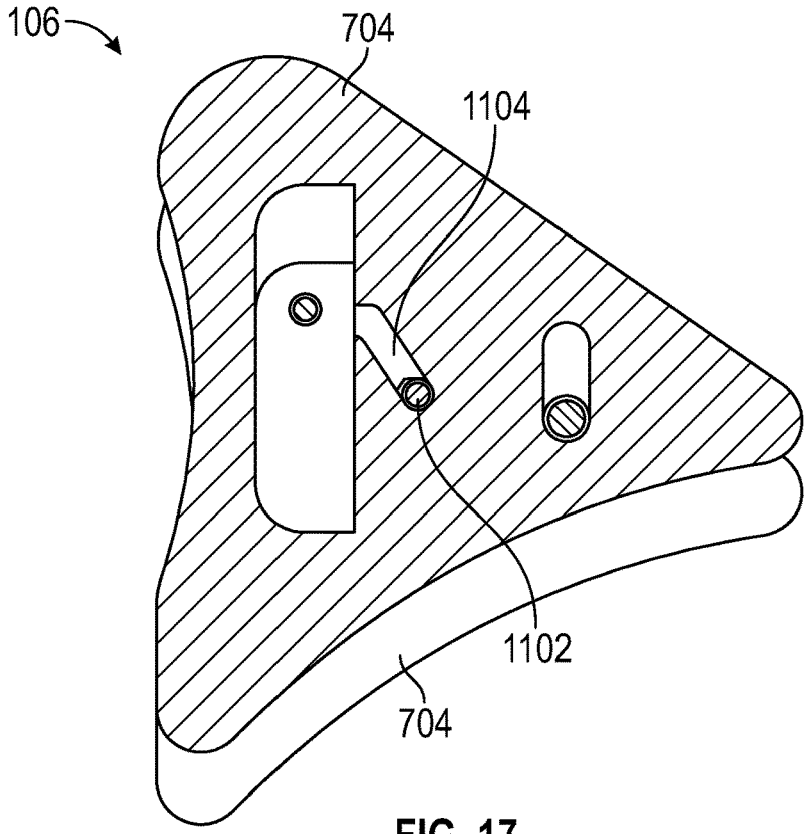
FIG. 17 is a cross-section view of an embodiment of a pistol grip rest in a second state.

Referring to FIG. 16, a cross-section of the pistol grip rest 106 is depicted. The pin 802 may be positioned within the first portion 702 of the pistol grip rest 106 and may be retracted away from the opening 804. Referring to FIG. 17, as the second portion 704 shifts relative to the first portion 702, the lateral post 1102 may slide along the oblique groove 1104 to withdraw the pin 802 into the first portion 702.

The weapon retention system 100 described herein, including the pistol grip rest 106, may include several advantages over typical weapon retention systems. For example, it may be adjustable to accommodate multiple types of firearm weapons including AR-type rifles and shotguns. Further, when a weapon is retained within the weapon retention system 100 as shown in FIGS. 4 and 5, it may sit against the pistol grip rest 106, preventing the second portion 704 from shifting and, thereby, preventing adjustment of the pistol grip rest 106 in a downward direction while a weapon is being retained. Also, as shown in FIG. 3, when the base assembly 102 is in the closed state, the second plate 105 covers and prevents access to the fastener 706 that connected the pistol grip rest 106 to the first plate 104. Thus, the added adjustability of the pistol grip rest 106 does not compromise the security of a weapon being retained in the system 100.

Figure 18:
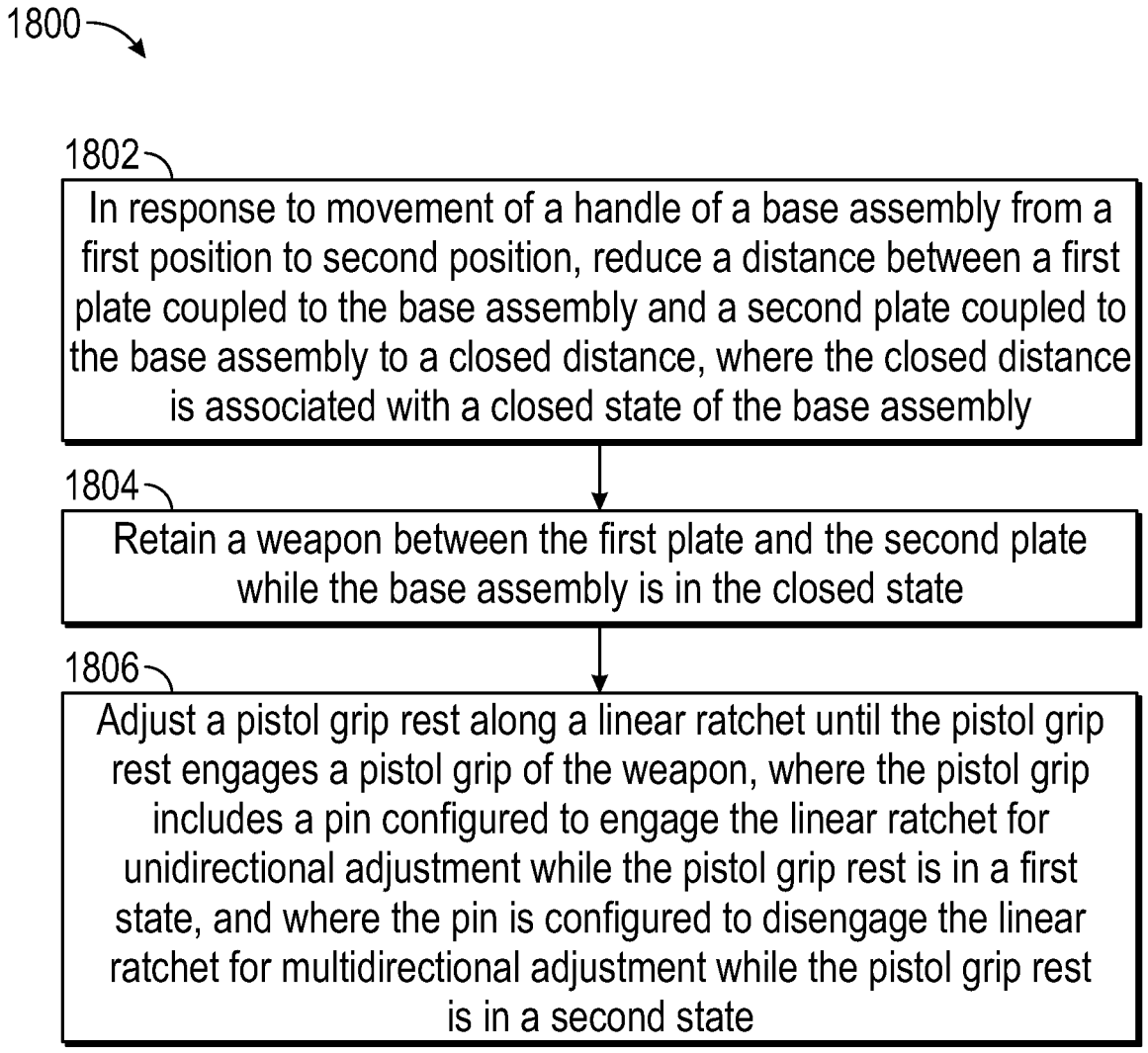
FIG. 18 is a flow chart depicting an embodiment of a weapon retention method.

Referring to FIG. 18, an embodiment of a weapon retention method 1800 is depicted. The method 1800 may include reducing a distance between a first plate coupled to a base assembly and a second plate coupled to the base assembly to a closed distance in response to movement of a handle of the base assembly from a first position to second position, where the closed distance is associated with a closed state of the base assembly, at 1802. For example, in response to movement of the handle 108 from a vertical position to a horizontal position, a distance between the first plate 104 and the second plate 105 may be reduced.

The method 1800 may further include retaining a weapon between the first plate and the second plate while the base assembly is in the closed state, at 1804. For example, the weapon 202 may be retained between the first plate 104 and the second plate 105.

The method 1800 may also include adjusting a pistol grip rest along a linear ratchet until the pistol grip rest engages a pistol grip of the weapon, where the pistol grip includes a pin configured to engage the linear ratchet for unidirectional adjustment while the pistol grip rest is in a first state, at 1806. For example, the pistol grip rest 106 may be adjusted along the linear ratchet 602 until it abuts the weapon 202.

Although various embodiments have been shown and described, the present disclosure is not so limited and will be understood to include all such modifications and variations as would be apparent to one skilled in the art.

The invention claimed is:

1. A weapon retention system comprising:

a base assembly;

a first plate coupled to the base assembly;

a second plate coupled to the base assembly, wherein an open distance between the first plate and the second plate while the base assembly is in an open state is greater than a closed distance between the first plate and the second plate while the base assembly is in a closed state, wherein the first plate and the second plate are configured to receive a weapon therebetween, and wherein the first plate and the second plate are configured to retain the weapon between the first plate and the second plate while the base assembly is in the closed state;

a linear ratchet coupled to the first plate; and a pistol grip rest coupled to the first plate, wherein the pistol grip rest includes a pin configured to engage the linear ratchet for unidirectional adjustment while the pistol grip rest is in a first state.

2. The system of claim 1, wherein the pin is configured to disengage the linear ratchet for multidirectional adjustment while the pistol grip rest is in a second state.

3. The system of claim 2, wherein the weapon interferes with switching the pistol grip rest from the first state to the second state while the weapon is retained between the first plate and the second plate and while a pistol grip of the weapon is resting against the pistol grip rest.

4. The system of claim 2, wherein the pistol grip rest includes a first portion and a second portion, wherein the second portion is configured shift relative to the first portion between a first position associated with the first state and a second position associated with the second state.

5. The system of claim 4, wherein the pin includes a main body positioned within the first portion and a lateral post positioned within the second portion, and wherein shifting the second portion to the second position interacts with the lateral post to draw the pin away from the linear ratchet.

6. The system of claim 4, wherein the pin is spring loaded and wherein shifting the second portion to the first position enables a spring to push the pin toward the linear ratchet.

7. The system of claim 1, wherein the linear ratchet enables the unidirectional adjustment at ⅛-inch intervals.

8. The system of claim 1, wherein the linear ratchet includes four ratchet steps.

9. The system of claim 1, wherein the first plate and the second plate omit any post configured to be positioned within a trigger guard of the weapon while the weapon is retained between the first plate and the second plate.

10. The system of claim 1, wherein the first plate is configured to interfere with charging the weapon while the weapon is retained between the first plate and the second plate.

11. The system of claim 1, wherein a first shape of the first plate and a second shape of the second plate are configured to retain an arma-lite (AR)-type rifle or a shotgun between the first plate and the second plate while the base assembly is in the closed state.

12. The system of claim 1, wherein the base assembly includes a handle that is moveable between a first handle position and a second handle position, wherein the first handle position is associated with the open state and the second handle position is associated with the closed state, and wherein the handle is configured to lock in the second handle position.

13. A weapon retention method comprising:

reducing a distance between a first plate coupled to a base assembly and a second plate coupled to the base assembly to a closed distance in response to movement of a handle of the base assembly from a first position to a second position, wherein the closed distance is associated with a closed state of the base assembly; and retaining a weapon between the first plate and the second plate while the base assembly is in the closed state; and adjusting a pistol grip rest along a linear ratchet until the pistol grip rest engages a pistol grip of the weapon, wherein the pistol grip includes a pin configured to engage the linear ratchet for unidirectional adjustment while the pistol grip rest is in a first state, and wherein the pin is configured to disengage the linear ratchet for multidirectional adjustment while the pistol grip rest is in a second state.

14. The method of claim 13, wherein the pin is configured to disengage the linear ratchet for multidirectional adjustment while the pistol grip rest is in a second state.

15. The method of claim 14, wherein the pistol grip rest includes a first portion and a second portion, wherein the method further comprises, in response to shifting of the second portion relative to the first portion from a first position associated with the first state to a second position associated with the second state, drawing the pin away from the linear ratchet.

16. The method of claim 15, further comprising, in response to shifting of the second portion to the first position, pushing the pin toward the linear ratchet.

17. The method of claim 13, wherein retaining the weapon between the first plate and the second plate is performed without positioning a post within a trigger guard of the weapon.

18. The method of claim 13, further comprising interfering, by the first plate, with charging the weapon while the weapon is retained between the first plate and the second plate.

19. A weapon retention system comprising:

a base assembly;

a first plate coupled to the base assembly;

a second plate coupled to the base assembly;

a linear ratchet coupled to the first plate; and a pistol grip rest coupled to the first plate, wherein the pistol grip rest includes a pin configured to engage the linear ratchet for unidirectional adjustment while the pistol grip rest is in a first state, and wherein the pin is configured to disengage the linear ratchet for multidirectional adjustment while the pistol grip rest is in a second state.

20. The system of claim 19, wherein the first plate and the second plate omit any post configured to be positioned within a trigger guard of the weapon while the weapon is retained between the first plate and the second plate, and wherein the first plate is configured to interfere with charging the weapon while the weapon is retained between the first plate and the second plate.

* * * * *